US005997397A

United States Patent [19]

Frickel et al.

[11] Patent Number: 5,997,397

[45] Date of Patent: Dec. 7, 1999

[54] LABORATORY WORKBENCH

[75] Inventors: Edmund Frickel, Gruüdau; Walter Glück, Hasselroth, both of Germany

[73] Assignee: Kendro Laboratory Products GmbH, Hanua, Germany

[21] Appl. No.: 09/092,468

[22] Filed: Jun. 5, 1998

[30] Foreign Application Priority Data

Jun. 6, 1997 [DE] Germany ..... 197 23 699

[51] Int. Cl.[6] ..... B08B 15/02

[52] U.S. Cl. ..... 454/60; 312/209; 454/57

[58] Field of Search ..... 312/209; 454/56, 454/57, 60

[56] References Cited

U.S. PATENT DOCUMENTS

| | | | |
|---|---|---|---|
| 3,041,957 | 7/1962 | Liptay | 454/56 |
| 3,941,040 | 3/1976 | Carlson | 454/56 |
| 4,553,992 | 11/1985 | Boissinot et al. | 454/56 X |
| 5,577,817 | 11/1996 | Reynolds | 312/209 X |

FOREIGN PATENT DOCUMENTS

| | | | |
|---|---|---|---|
| 27 16 317 | 10/1977 | Germany | 454/57 |

*Primary Examiner*—Harold Joyce
*Attorney, Agent, or Firm*—Workman, Nydegger & Seeley

[57] ABSTRACT

A laboratory workbench includes a housing bounding a working space. The working space communicates with the exterior through a window bordering the working space on one of its sides thereof. A fan produces a flow of air in the working space and out the window. A protective screen is arranged on the housing in such a way that it can be moved. Specifically, the protective screen is mounted on the housing in the top area of the working space window in such a way that the protective screen can be moved between a hanging position at least partially covering the window, and a folded-up position. In the folded-up position, the protective screen projects into the housing in a substantially horizontal position plane. In one embodiment, an expansion screen is movable attached to the protective screen and has reach through openings formed therethrough.

11 Claims, 3 Drawing Sheets

LABORATORY WORKBENCH

BACKGROUND OF THE INVENTION

1. The Field of the Invention

This invention relates to laboratory workbenches and, more specifically, product protection workbenches having a protective screen partially covering a working space.

2. Present State of the Art

A conventional laboratory workbench includes a housing having a working space. A window borders the working space on one side thereof. A fan produces a flow of air in the working space, and a protective screen is arranged on the housing in such a way that it can be moved. Such laboratory workbenches are known from GB 2 112 927 A or from US-A-4 179 984, for example. The company brochure "Heraeus Biological Safety Workbenches Laminair HB and HBB" of Heraeus Instruments GmbH also discloses such a laboratory workbench.

Laboratory workbenches are generally used to protect the product being handled or processed in them, the operator, and/or the environment. Safety is ensured by a suitable flow of air. Laboratory workbenches which emphasize product protection are intended to prevent contamination from the surroundings penetrating into the working space. For this purpose, a flow of air which is produced by the fan is aimed from the working space through the window to the outside.

Partially covering the window by a protective screen through which an operator can observe the operation within the working space is known from GB 2 112 927 A. On occasion, it is necessary that the protective screen be removed from the window so that the full size of the window is open. For this purpose, folding the protective screen up on the outside and also laying it on the top of the housing is known from US-A-4 179 984. Folding up the protective screen on the outside of the housing not only requires available space, but also harbors some safety risks when it is operated. This is because, for a number of reasons, the frame of such a protective screen is kept very thin and inconspicuous, as a rule. As such, there is the danger that a person in the vicinity could injure himself on the protective screen folded up outside of the housing if he did not see or was not aware of the protective screen.

OBJECTS AND BRIEF SUMMARY OF THE INVENTION

Accordingly, it is an object of present invention to provide a laboratory workbench in which a protective screen can be moved in a suitable manner and in which the danger of accidents is reduced to a minimum, while simultaneously protecting the operator from influences coming from the working space.

To achieve the foregoing objects, and in accordance with the invention as embodied and broadly described herein, a laboratory workbench is provided. The workbench includes a housing having a working space. The working space communicates to the exterior through a window. A protective screen is mounted on the housing in the top area of the window in such a way that the protective screen can be moved between a hanging position, at least partially covering the window, and a folded-up position. In the folded-up position, the protective cover projects into the housing. In on embodiment, the protective cover projects into the housing so as to be at a position which is at least approximately horizontal. In the folded-up position, the protective screen is within the contours of the laboratory workbench. As a result, no sharp-edged parts of the protective screen project into the surroundings, thereby endanger people. This simultaneously ensures maximum use of the window.

The inventive laboratory workbench also includes a fan that produces a flow of air that is aimed essentially horizontally through the working space. As a result, the flow of air produces a pressure which is as uniform as possible over the entire cross-section of the window from the working space out into the surroundings. Such workbenches having a flow of air aimed into the surroundings are also called product protection workbenches. The primary intent of such workbenches is to prevent contamination of the working space or product therein by cells from the surroundings.

In one embodiment, it is advantageous to arrange a lighting device in the housing above the working space or in its top area. It is envisioned that the lighting device can include ultraviolet light emitters. First, this can ensure good illumination of the working space. Second, radiation can be used to sterilize or disinfect the working space. In this case, the protective screen not only acts to protect against drafts or as a splash guard, but it also protects the from accidental contact, thereby protecting the UV radiator from mechanical destruction. On the other hand, the protective screen also protects the operator from burns or other injuries from the UV radiator.

The protective screen is normally made of glass. In one embodiment, the glass is largely non-permeable to UV radiation so that the protective screen simultaneously provides protection from ultraviolet radiation. When the protective screen is folded down, the protective screen provides protection from ultraviolet radiation that is both directed out and reflected out of the working space towards an operator. In the folded-up position, the protective screen is advantageously arranged in a substantially horizontal position beneath the lighting device. As a result, the protective screen also protects the arms of the operator when the protective screen is folded up. That is, it is impossible for accidental UV irradiation on the arms of the operator when the protective screen is in the folded-up position.

To make construction simple, it is expedient for the protective screen to be hinged in the housing by means of horizontal bolts. It is also expedient to provide latching devices on the housing and/or on the protective screen to hold the protective screen in its hanging and/or horizontal folded-up position, thereby making it simple to move and fix the protective screen.

It can be expedient for the protective screen to have a movable expansion screen arranged on it in such a way that the expansion screen can be moved in front of a part of the window not covered by the protective screen. For this purpose, it is helpful for the expansion screen to be arranged so that it can fold, for example my means of a hinge joint on the lower edge of the protective screen. However, it would also be conceivable to arrange the expansion screen in another way. For example, the expansion screen can be mounted on the protective screen in such a way that the expansion screen can slide parallel to the protective screen.

It is advantageous to arrange at least one reach-through opening in the expansion screen. This can be a relatively large, open opening, or two openings, having protective gloves arranged in them for manipulating in the working space.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
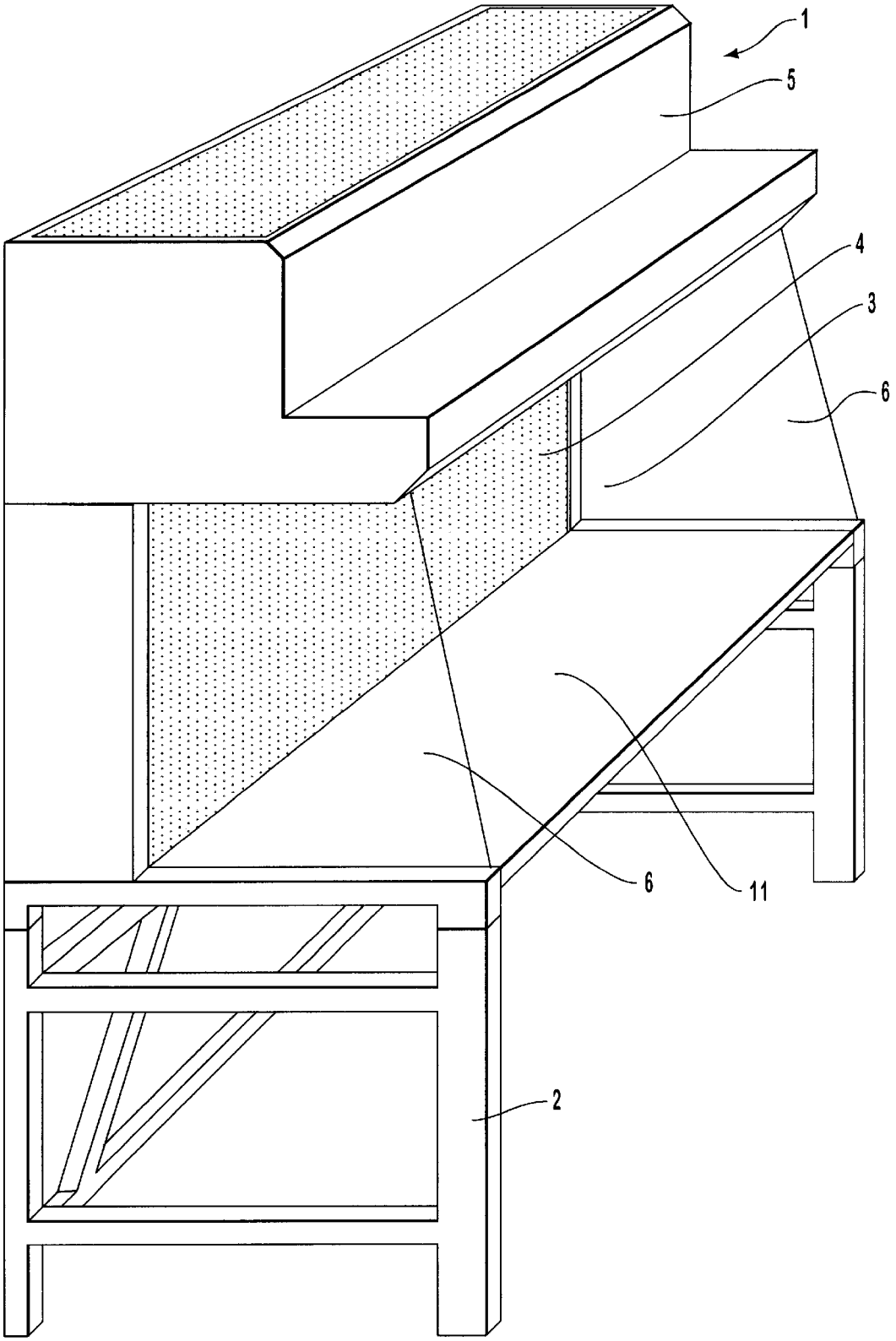
FIG. 1 is an overall perspective view of a laboratory workbench.

Depicted in FIG. 1 is a laboratory workbench 1, also called a product protection workbench, arranged on a table underframe 2. Laboratory workbench 1 has a working space 3 which is bordered on its back end by a perforated wall 4 and which has a functional unit 5 arranged on its top end. The functional unit 5 contains essential electrical and electronic functional elements, filters, and other components. The perforations in the back wall 4 have air flowing horizontally frontward through them. The air is moved by a fan arranged in the functional unit 5. The working space 3 is bordered on its sides by side screens 6 and on its front by window 11.

Figure 2B:
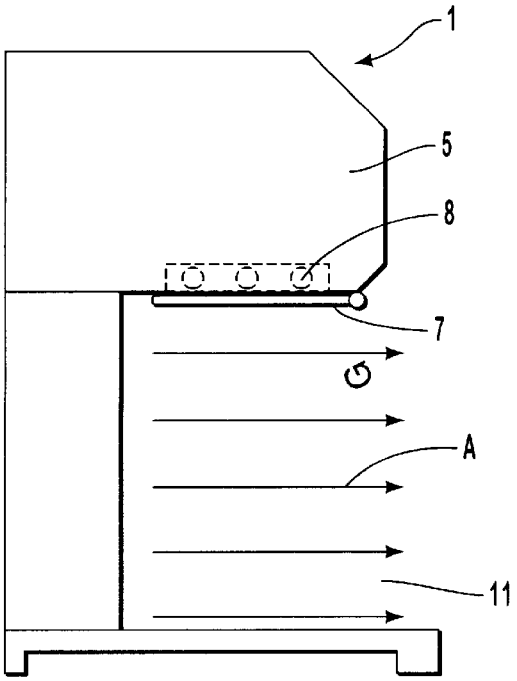
FIG. 2*b* is a side view of the working space shown in FIG. 2*a* with the protective screen folded up.
Figure 2C:
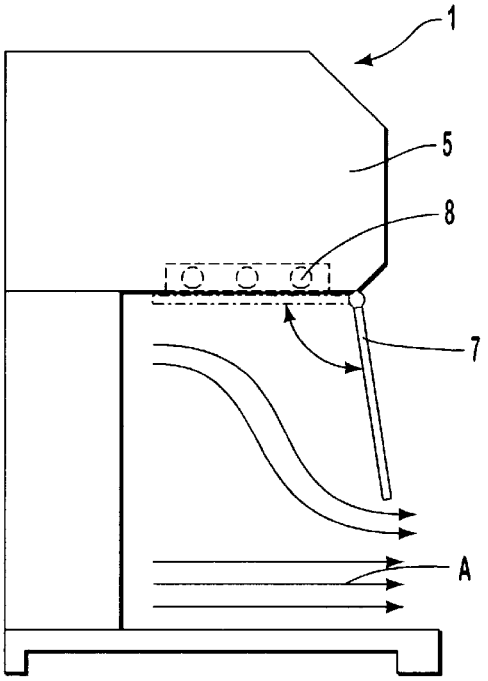
FIG. 2*c* is a side view of the working space shown in FIG. 2*a* with the protective screen folded down.
Figure 2A:
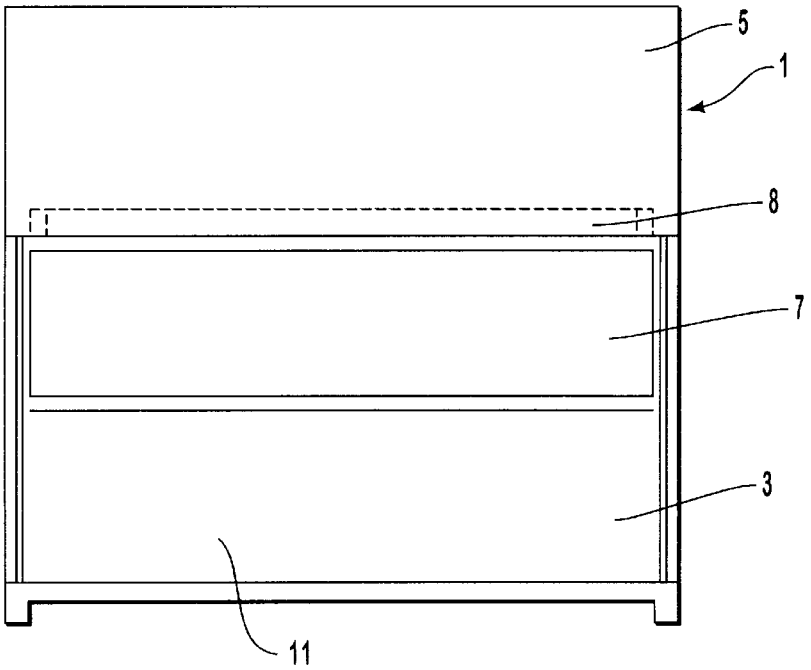
FIG. 2*a* is a front view of the working space of the laboratory workbench shown in FIG. 1 with a protective screen folded down.

FIG. 2 show the arrangement of a protective screen 7 of the laboratory workbench 1. Specifically, FIGS. 2*a* and 2*c* show a folded down hanging protective screen 7 and FIG. 2*b* shows a protective screen 7 folded into a substantially horizontal position inside the housing. In the folded up position, the protective screen 7 covers a lighting device 8. Lighting device 8 is arranged in the lower part of the functional unit 5 and above the working space 3. The flow of air is shown by the arrows A in FIGS. 2*b* and 2*c*. The lighting device 8 can consist entirely or partially of UV radiators.

Figure 3B:
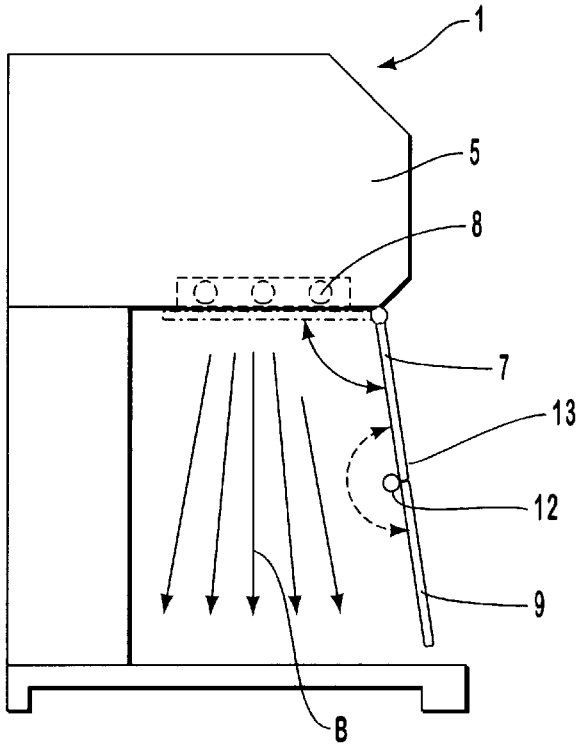
FIG. 3*b* is a side view of the working space shown in FIG. 2*b* with the expansion screen folded down.
Figure 3A:
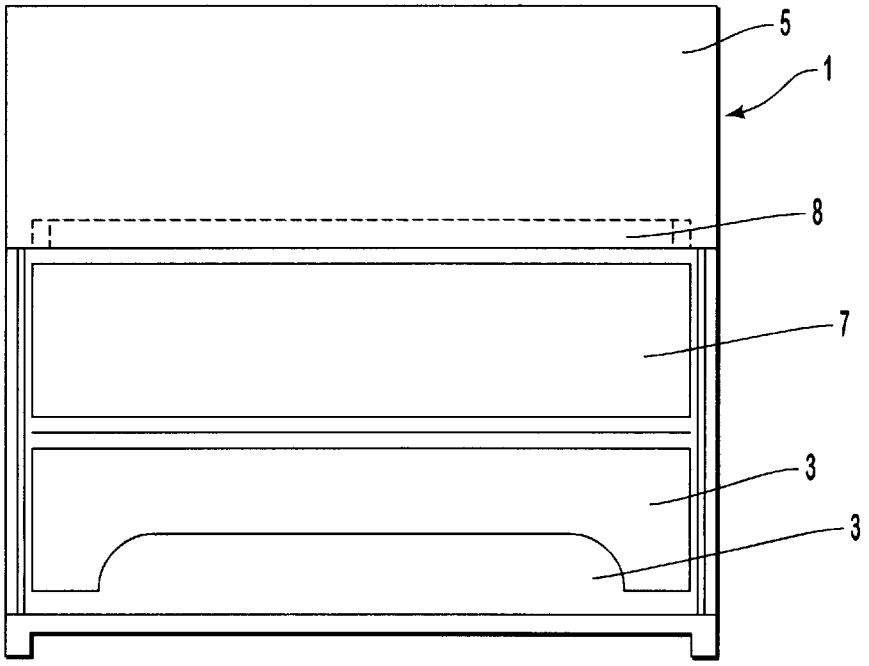
FIG. 3*a* is a front view of the working space shown in FIG. 2*a* with an expansion screen folded down.

FIG. 3 shows a laboratory workbench 1 which has an expansion screen 9 arranged on its protective screen 7. The expansion screen 9 is arranged on a lower edge 13 of the protective screen 7 by means of a hinge joint 12. In this configuration, expansion screen 9 can swing inward (into the working space 3) against the protective screen 7. It is expedient to latch expansion screen 9 on protective screen 7 in this position, for example, by means of latching devices which are not shown in the drawing but are generally well-known (hooks, sliding bolts, or the like). The expansion screen 9 has a reach-through opening 10 on its lower end, which extends over the greater part of the width of the expansion screen 9.

The arrows B in FIG. 3*b* show the ultraviolet radiation coming from the lighting unit 8. It can be clearly seen that an operator standing in front of the window of the laboratory workbench 1 is protected to the maximum extent possible from the influence of ultraviolet radiation by the protective screen 7, including the expansion screen 9.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A laboratory workbench comprising:

(a) a housing bounding a working space, the working space communicating with the exterior through a window having a top area;

(b) means for producing a flow of air within the working space; and (c) a protective screen mounted on the housing in the top area of the window, the protective screen being movable between a hanging position at least partially covering a portion of the window and a folded-up position wherein the protective screen projects into the housing.

2. A laboratory workbench according to claim 1, wherein the protective screen is disposed in a substantially horizontal plan when in the folded-up position.

3. A laboratory workbench according to claim 1, wherein the flow of air within the working space travels substantially horizontally through the working space.

4. A laboratory workbench according to claim 1, further comprising a lighting device disposed within the housing above the working space.

5. A laboratory workbench according to claim 4, wherein the lighting device comprises an ultraviolet light-emitting radiator.

6. Laboratory workbench according to claim 4, wherein the protective screen is disposed between the lighting device and the working space when the protective screen is in the folded-up position.

7. A laboratory workbench according to claim 1, wherein the protective screen is hinged to the housing by a horizontal bolt.

8. A laboratory workbench according to claim 1, further comprising means for securing protective screen in the folded up position.

9. A laboratory workbench according to claim 1, further comprising an expansion screen movably attached to the protective screen, the expansion screen being selectively movable in front of a portion of the window not covered by the protective screen.

10. A laboratory workbench according to claim 9, wherein the protective screen has a lower edge and the expansion screen is hingedly attached to the lower edge of the protective screen.

11. A laboratory workbench according to claim 9, wherein the expansion screen has at least one reach-through opening formed thereon.

* * * * *

UNITED STATES PATENT AND TRADEMARK OFFICE

CERTIFICATE OF CORRECTION

PATENT NO. : 5,997,397
DATED : December 7, 1999
INVENTOR(S) : Edmund Frickel; Walter Gluck It is certified that error appears in the above-identified patent and that said Letters Patent is hereby corrected as shown below:

Cover Page, under U.S. PATENT DOCUMENTS, please insert
--4,179,984 12/25/79 Gorcey--

Cover Page, under FOREIGN PATENT DOCUMENT, please insert
--2112927 09/08/82 Great Britain--

Cover Page, under Other Publications, please insert the following publications:

--Fume Cupboard, Labcaire for Tomorrow's Environment brochure, Labcaire Systems, Ltd., Avon, England, 1995.--

--Airone Work Station brochure, Safelab Systems, Ltd., Bristol Great Britain, 1996.--

--Heraeus Instruments brochure for LaminAir HB and HBB, Hanau, Germany, 1993.--

--Labcaire Systems, Ltd., TC Cabinet Layout, 1995.--

Cover Page, Abstract,
Line 14, change "movable" to --movably--

Column 1,
Line 63, after "In" change " to --one--

UNITED STATES PATENT AND TRADEMARK OFFICE

CERTIFICATE OF CORRECTION

PATENT NO. : 5,997,397
DATED : December 7, 1999
INVENTOR(S) : Edmund Frickel; Walter Gluck It is certified that error appears in the above-identified patent and that said Letters Patent is hereby corrected as shown below:

Column 2,
Line 2, after "thereby" change "endanger" to --endangering--
Line 20, after "protects the" insert --lighting device--
Line 52, after "example" change "my" to --by-- (Ours)

Signed and Sealed this

Nineteenth Day of June, 2001

*Attest:*

Nicholas P. Godici

*Attesting Officer*

NICHOLAS P. GODICI
*Acting Director of the United States Patent and Trademark Office*